United States Patent [19]

Hutt

[11] 3,947,198

[45] Mar. 30, 1976

[54] APPARATUS FOR MAKING BAGS FROM SYNTHETIC PLASTIC FILM

[76] Inventor: Thomas Gough Hutt, 936 Pretorius St., Arcadia, Pretoria, Transvaal Province, South Africa

[22] Filed: Dec. 6, 1974

[21] Appl. No.: 530,377

[30] Foreign Application Priority Data

Dec. 12, 1973 South Africa ..... 73/9438

[52] U.S. Cl. ..... 425/327; 93/33 H; 93/8 R; 93/34; 156/515; 93/35 R

[51] Int. Cl.[2] ..... B31B 21/14

[58] Field of Search..... 93/33 H, DIG. 1, 8 R, 33 R, 93/35 R, 34, 59 ES; 156/515; 425/327

[56] References Cited

UNITED STATES PATENTS

| | | | |
|---|---|---|---|
| 2,206,965 | 7/1940 | Lakso | 93/DIG. 1 |
| 3,054,441 | 9/1962 | Gex et al. | 93/DIG. 1 |
| 3,224,161 | 12/1965 | Conti | 93/DIG. 1 |
| 3,286,005 | 11/1966 | Cook | 93/34 UX |
| 3,474,712 | 10/1969 | Pino et al. | 93/59 ES X |
| 3,522,689 | 8/1970 | Wylie et al. | 93/33 H UX |
| 3,663,338 | 5/1972 | Wech | 156/515 |
| 3,804,571 | 4/1974 | Upmeier | 425/327 X |

*Primary Examiner*—James F. Coan
*Attorney, Agent, or Firm*—Karl W. Flocks

[57] ABSTRACT

A bag-making machine including a longitudinally slotted roller and feed means for feeding plastic film onto the roller. A synchronised cutter sealing member is displaceable cyclically to cause it to enter a slot of the roller to cut and seal the film. Mating formations on the cutter sealing member and roller are engageable at the start of each cycle and moveable arcuately in unison before disengaging. This engagement ensures accurate registration of the cutter sealing member with a slot during simultaneous arcuate movement thereof.

An inline bag-making installation including the bag-making machine.

A bag-making method which includes feeding plastic film over a longitudinally slotted roller and moving a synchronised cutter sealing member cyclically to engage the roller cyclically in registration with a slot thereon, and to move arcuately in unison therewith while sealing and cutting the film.

12 Claims, 17 Drawing Figures

APPARATUS FOR MAKING BAGS FROM SYNTHETIC PLASTIC FILM

This invention relates to a method of making bags from synthetic plastic film, and to apparatus therefor. It relates more particularly to the extrusion of such film in tubular blown form from an extruder, and the subsequent processing of such film for making bags, including the printing of such film.

According to the invention there is provided a method of making bags from synthetic plastic film, which includes the steps of:

a. feeding a continuously moving web comprising at least two layers of heat-sealable synthetic plastic film over a cylindrical roller having a plurality of circumferentially spaced slots extending longitudinally in its periphery;

b. rotating the roller about its axis at a rate corresponding to the rate of feed of the web;

c. causing a cutter sealing member disposed transversely to the direction of movement of the web, and having a cutter blade to move in synchronism with the roller cyclically from an initial position towards the roller axis and to engage with the roller or with a member fast with the roller to ensure accurate registration of the cutter blade with one of the slots in the roller periphery;

d. then causing the cutter sealing member to move for a period in unison with the roller in an arc about the roller axis, during which period the cutter sealing member engages the film layers, and sealing and cutting of the film layers take place;

e. causing the cutter sealing member, when it reaches the end of the arc, to move away again from the roller axis to become disengaged from the film layers and from the roller or from the member fast with the roller; and f. then causing the cutter sealing member to return to its initial position for a new cycle of operation.

Further according to the invention, there is provided a bag-making machine, which includes:

a. a cylindrical roller having means to rotate it about its axis, the roller having a plurality of circumferentially spaced longitudinal slots in its periphery;

b. feed means adapted to feed a continuous web of heat-sealable synthetic plastic material to the roller at a rate corresponding to the rate of rotation of the roller;

c. a cutter sealing member mounted to be displaceable both radially relative to the roller axis and arcuately about the roller axis and having a cutter blade adapted in operation to register with and to enter into a slot of the roller, the cutter sealing member thereby cutting and sealing the film layers;

d. displacing means for cyclically displacing the cutter sealing member arcuately about and radially relative to the roller axis and in synchronism with the roller; and e. mating formations fast with the roller and with the cutter sealing member respectively, and adapted to engage with each other at the start of a cycle of operation, and to move in unison with each other over an arc about the roller axis, and to disengage from each other at the end of the arc, the mating formations being adapted to ensure, upon inter-engagement with each other, that the cutter blade registers accurately with and remains in registration with a slot in the roller surface during the period of travel over the arc, during which period the mating formations are engaged and the cutter sealing member and roller are moving in unison over the arc, and during which period sealing and cutting of the film layers is taking place.

The displacing means may include a pair of chains at opposite ends of the roller, the chains supporting the cutter sealing member between them.

If desired, the cutter sealing member may be arranged to perform reciprocal cyclic movements peripherally with the roller, and inwardly and outwardly relative to the roller axis, the periods of such cyclic movements, together with the rate of rotation of the roller and its diameter, determining the length of the bags. Thus the displacing means may include a crank wheel meshing with a toothed wheel fast and co-axial with the roller and driven thereby, and a link lever system connected via a crank pin to the crank wheel and adapted to displace the cutter sealing member to have a reciprocating movement to cause the cutter sealing member to perform working and return strokes while moving in a closed, substantially elliptical path. The reciprocating movement of the crank in a downstream and upstream direction, is responsible for the movement of the cutter sealing member, first downstream with the peripheral movement of the roller surface, and then upstream against the peripheral movement of the roller surface.

The link lever system may be adapted to reduce the displacement of the cutter sealing member in a direction transverse to the direction of travel of the web to a value less than the throw of the crank pin. This is done by the link lever system having a mechanical advantage such that the transverse displacement of the cutter and sealing member in a direction transverse to the direction of movement of the web, is a suitable fraction, say, of about half of the crank radius.

The mating formation for the roller may include a toothed wheel fast and co-axial with the roller, the number of teeth of the wheel corresponding to the number of slots in the drum, and the mating formation for the cutter sealing member may include at least one tooth adapted to mesh with the said toothed wheel. The slots in the roller may be aligned with the spaces between the teeth of the toothed wheel, and may have a width only slightly wider than the cutter blade, thus permitting the cutter blade to pass with clearance into the slots. The link mechanism and the toothed wheel are interconnected to ensure that the strokes of the cutter sealing member are performed in synchronism with the rotation of the roller.

The cutter sealing member may include a carrier which carries the cutter blade, and the carrier may include a pair of aligned forks at opposite ends of the roller, the forks permitting displacement of the carrier both arcuately about and radially relative to the roller axis. The cutter blade may be resiliently mounted on the carrier to be resiliently displaceable away from the roller axis relative to the carrier.

The roller may have a plurality of axially spaced, narrow circumferential grooves at least as deep as the longitudinal slots, and there may be provided take-off fingers having their upstream ends within the circumferential grooves and extending downstream away from the roller relative to its direction of rotation. The take-off fingers may be in the form of thin plates, and the circumferential grooves may be of a width to accommodate the take-off fingers with running clearance. The circumferential grooves may be deeper than the longitudinal slots, and the take-off fingers may extend radially into the grooves to such an extent that at least part of the upstream ends of the take-off fingers are closer to the axis of the roller than are the bottoms of the longitudinal slots.

The invention extends also to the modification of a bag-making machine having feed means adapted to feed a continuous web comprising at least two layers of heat-sealable synthetic plastic material to pass over a rotating roller which has a plurality of longitudinal slots spaced circumferentially, and having a cutter sealing member registering cyclically with one of the slots in the roller and sealing and cutting the film at the slot, by the provision in the roller of a plurality of narrow circumferential grooves spaced axially, the grooves having a depth at least that of the longitudinal slots, and by the provision of the take-off members with running clearance within the grooves and extending downstream away from the roller relative to its direction of rotation.

The take-off members may be in the form of plates or sheets arranged to lie in planes at right angles to the roller axis.

If desired, intercalating corrugated take-off rollers may be provided immediately downstream of and in alignment with the take-off members.

The invention extends also to an inline bag-making installation comprising:

a bag-making machine as described, draw rollers mounted in line with and upstream of the bag-making machine;

a printer in line with and upstream of the draw rollers, the printer having at least one set of printing rollers comprising an impression roller and a stereo roller and other associated rollers; and interconnecting drive means drivingly interconnecting the cylindrical roller of the bag-making machine with the draw rollers and with the or all the impression rollers of the or all the sets of printing rollers, for synchronous operation of the said interconnected rollers.

The invention will now be described by way of example, with reference to the accompanying drawings.

Figure 1:
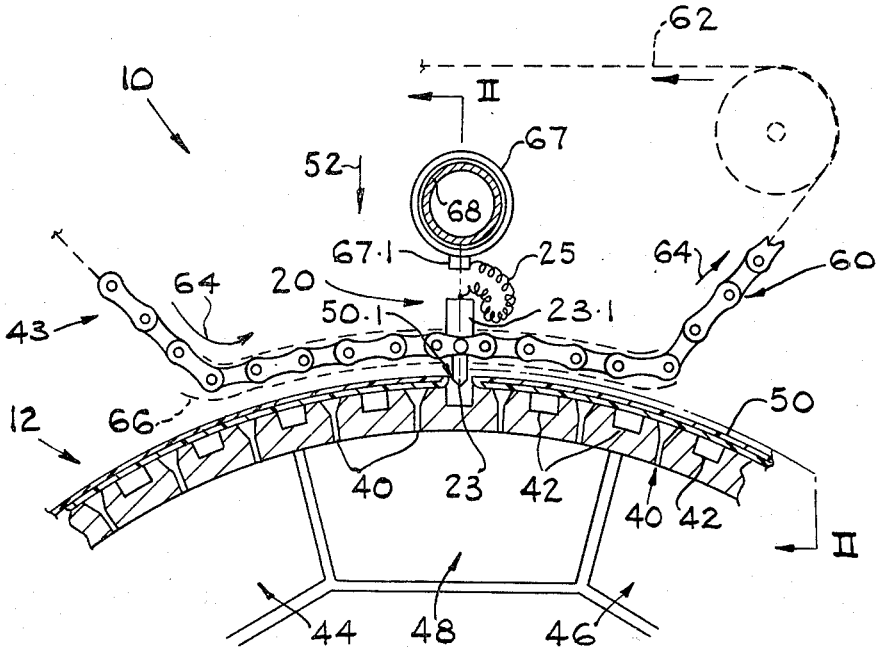
FIG. 1 shows diagrammatically a part-sectional side elevation at I—I in FIG. 2 of a drum and cutter sealing means adapted to move in a closed path in combination with cam means in the form of a path, for a bag making machine in accordance with the invention.
Figure 2:
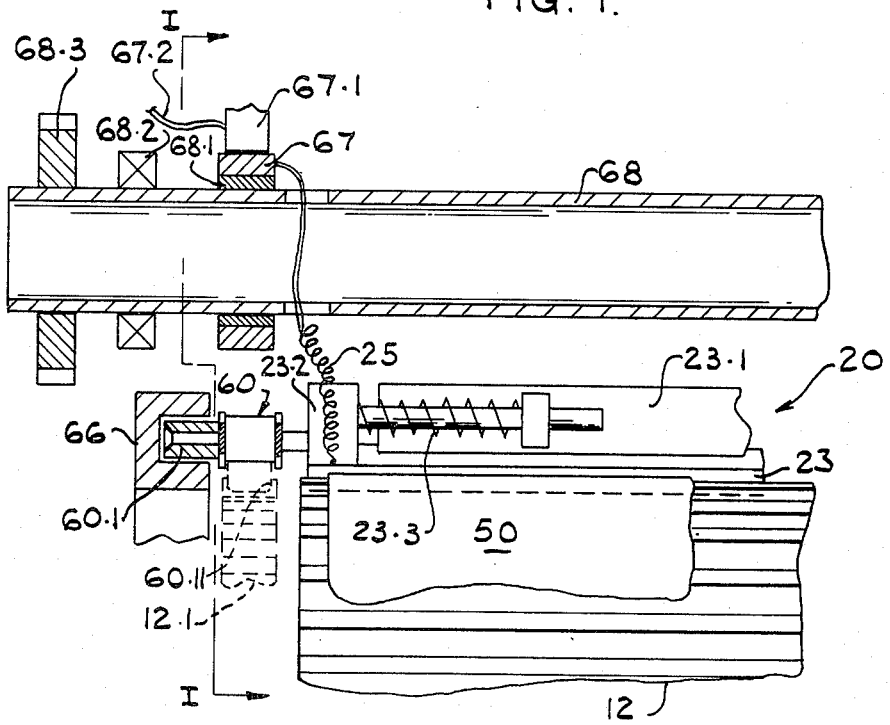
FIG. 2 shows diagrmmatically a part-section view along II—II of FIG. 1.

Referring to FIGS. 1 and 2 of the drawings, reference numeral 10 refers generally to the sealing part of a bag-making machine according to the invention having a hollow roller 12. The roller is mounted rotatably about its axis (not shown). A cutter sealing member 20 extending axially parallel to the rotational axis of the roller, is supported at both ends of the roller by axially spaced supports. The cutter sealing member 20 is adapted to move arcuately with the peripheral movement of the roller, thereby moving in unison with the roller over a predetermined arc length. The cutter sealing member 20 has a heat-sealing element including a blade 23 energised via flexible leads 25. The element or blade 23 is mounted in carrier 23.1.

The roller has a plurality of perforations 40 and a plurality of circumferentially spaced axially extending slots 42 between the said perforations. The roller is arranged to rotate in the direction of arrow 43. On the inside of the roller there are provided low vacuum cavities 44 and 46, and between them a high vacuum cavity 48. When these cavities are subjected to subatmospheric pressure, then ambient atmospheric pressure presses upon layers of synthetic plastic film 50 drawn against the periphery of the roller and the film thus moves with the roller as it rotates. The film 50 is fed over the roller 12 at a uniform rate corresponding to the rate of rotation of the roller.

The cutter sealing member 20 is arranged to be displaced inwardly in the direction of arrow 52 when the blade 23 is in register with a slot 42. Upon such displacement of the member 20, the blade 23 intersects the synthetic plastic film 50 at 50.1 where it spans the opposed edges defining the slot, thereby cutting through the synthetic plastic film, the member 20 sealing the film at the same time. The blade 23 of the cutter sealing member 20 is conveniently a heat cutter. The blade 23 engages the layers of plastic material at 50.1 at the entrance to cam path 66 and remains in that position 50.1 until the end of the cam path 66.

The carrier 23.1 is mounted between a pair of chains 60 spaced laterally from each other along the length of the roller 12, each arranged to travel in a closed path 62 in proximity to the roller 12 in the direction of arrows 64. These chains may be spaced at a spacing corresponding to or somewhat larger than the length of the roller 12. At least one, and conveniently a plurality of serially spaced cutter sealing members 20 is provided, the members 20 being mounted on the chains and spaced in series from each other longitudinally in the direction of travel of the chains. The chains 60 have rollers 60.1 engaging with the cam paths 66. The chains 60 and the roller 12 may have mating formations fast with them in the form respectively of teeth 60.11 and 12.1 engaging with each other, the chains being driven by the roller 12, there being a plurality of teeth 60.11 on each of the chains 60 and the teeth 12.1 being provided on a pair of toothed wheels mounted at opposite ends of the roller 12. Instead of the chains 60, there may be provided toothed belts.

The blade 23 is held at its ends in clamp blocks 23.2 biassed away from each other relative to carrier 23.1, by coil springs 23.3 under compression mounted in carrier 23.1. The flexible leads 25 for energizing the blade 23 are connected to axially spaced slip rings 67 mounted on hollow shaft 68 via insulating rings 68.1. The shaft 68 is mounted to be rotatable about its axis on axially spaced bearings 68.2 and is driven by means of gear or sprocket 68.3 to rotate at a speed corresponding to the speed of the chains 60 or belts, such that it will perform a full revolution for every full cycle of travel of the chains 60. The slip rings 67 are energized via brushes 67.1 having energizing leads 67.2.

The spacing of the blades 23 along the chains 60, will determine the length of the bag or the width of the bag, i.e. the distance between consecutive seals in a bag.

Figure 3:
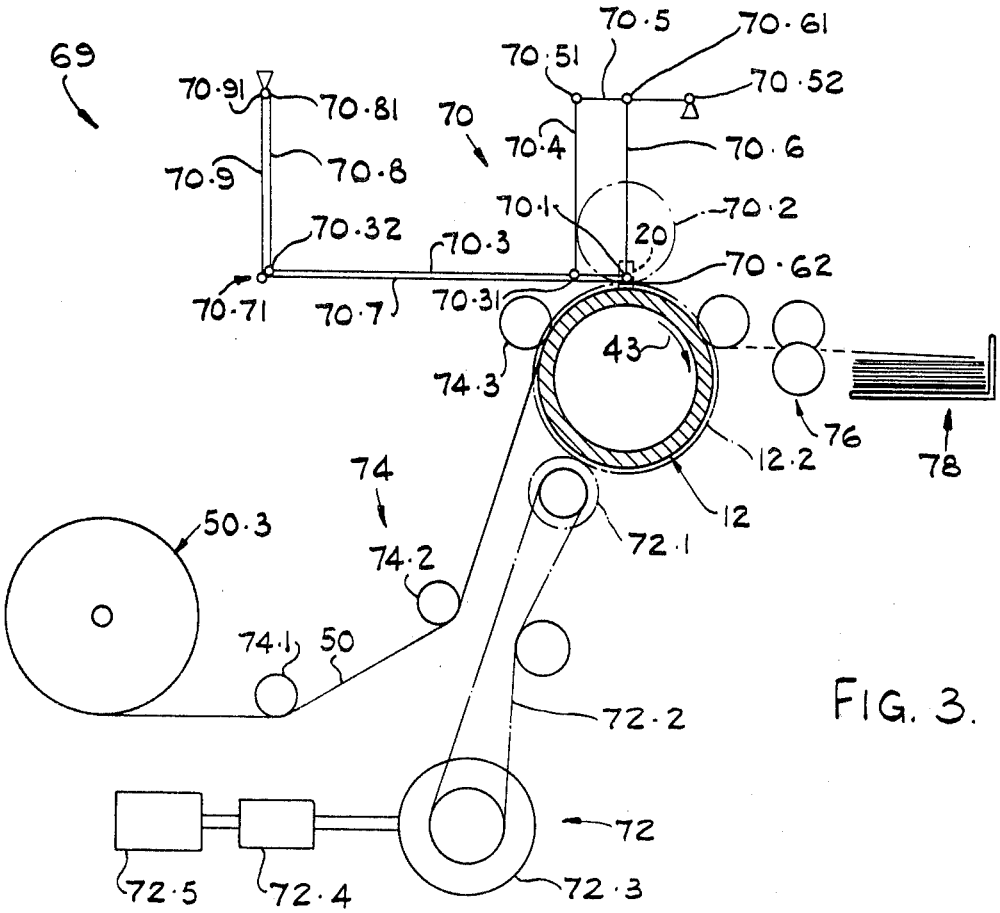
FIG. 3 shows diagrammatically a line diagram in side elevation of a bag-making machine in accordance with the invention with its link system for providing reciprocal movement to a cutter sealing member.

Referring now to FIG. 3 of the drawings, numeral 69 refers generally to another bag-making machine according to the invention, shown diagrammatically in side elevation, and unless otherwise specified like reference numerals refer to like parts. The machine comprises generally a link lever system 70, a roller 12, drive means 72 for driving the roller, feed means 74 for feeding the layers of plastic film 50 onto the roller 12, and take-off means 76 adapted to take off the bags after they pass over the roller, and arranged to pass bags on to stacking means 78 after they leave the take-off means 76 which comprises intercalating corrugated rollers. In addition, the machine includes counter means 80 driven in synchronism with the cutter sealing member in a manner to be described more fully hereafter, to count the number of bags and to operate the stacking means 78 when a predetermined number of bags have been stacked on the stacking means.

The various parts of the machine will now be described in greater detail.

The link lever system 70 is adapted to impart reciprocating forward and backward movement to the cutter sealing member 20, relative to the direction of rotation of the roller 12 as indicated by arrow 43. The link lever system is also adapted to provide radial movement towards and away from the axis of the roller 12, for bringing the cutter sealing member 20 into and out of contact with the layers of synthetic plastic film 50 passing over the roller 12 for bag-making purposes. The roller 12 is itself driven by the drive means 72 via a toothed wheel 12.2. The wheel 12.2 meshes with an interchangeable crank wheel in the form of a gear 70.2 carrying a crank pin 70.1 at a radius corresponding to that of the pitch circle of the gear 70.2. The toothed wheel 12.2 is fast and co-axial with the roller 12. The pitch circle circumference of the gear 70.2 determined the length of bags produced by the machine 69.

Figure 4:
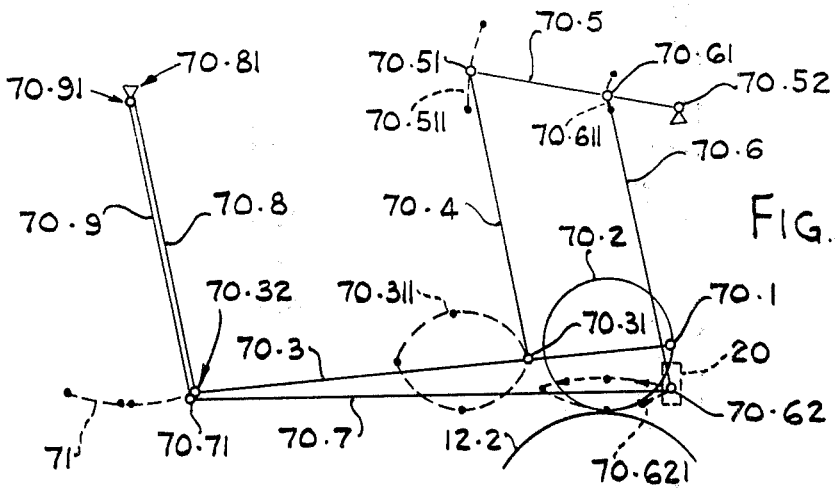
FIG. 4 shows diagrammatically a side elevation of the link system at a different time in its cycle from that shown in FIG. 3.

The link lever system 70 includes a connecting rod 70.3 pivotally connected to the crank pin 70.1 and pivotally supporting a strut 70.4 at 70.31. The strut 70.4 is adapted to displace the effort arm of a lever 70.5 via a pivotal connection 70.51, the lever 70.5 having its fulcrum at 70.52. The lever 70.5 has one end of a tie member 70.6 pivotally connected to its at 70.61. Longitudinally spaced along the tie member is the cutter sealing member 20, pivotally connected thereto at 70.62. Also pivotally connected to the cutter sealing member at 70.62 is a walking beam 70.7 having a remote end 70.71 adapted to move in correspondence with the remote end 70.32 of the connecting rod 70.3. Both the members 70.3 and 70.7 are pivotally connected respectively at 70.32 and 70.71 to the lower ends of hanging members 70.8 and 70.9. The hanging members 70.8 and 70.9 are respectively pivotally hung from pivotal fixed mountings 70.81 and 70.91. In fact the remote ends 70.71, 70.32 of the beam 70.7 and rod 70.3 are conveniently interconnected by being pivotable independently of each other about a common pivot axis, so that the hanging members 70.8 and 70.9 may in fact be a single member pivotally hung from a single fixed mounting 70.81, 70.91. The lower end of the single hanging member will thus have the beam 70.7 and rod 70.3 axially pivotally connected thereto at 70.71, 70.32 so that the rod and beam can pivot independently of each other about the axis at 70.71, 70.32, the beam 70.7 responding to horizontal to and fro movement of the rod 70.3 (caused by movement of the crank pin 70.1) by moving horizontally to and fro (see locus 71 of ends 70.71, 70.32 in FIG. 4 discussed below).

The drive means 72 may comprise a drive roller 72.1 driven by means of a chain 72.2 or by any other suitable means from a gearbox 72.3 which may be of the epicyclic type. The gearbox 72.3 may itself be driven from a reduction gearbox 72.4 driven by a motor 72.5. This motor 72.5, in an installation in which the bag making machine is mounted in line with an extruder and printing apparatus, may be driven at a speed corresponding to the speed of the synthetic plastic material coming off the printer. This speed regulation may be obtained by electrically interconnecting the motor 72.5 with the motor driving the haul-off rollers hauling off the film from the printers. Alternatively, the gearbox 72.3 may be mechanically driven from a single source of power, supplying power also to the haul off rollers from the printers.

On the other hand, the synthetic plastic film may be supplied at a uniform rate from a roll 50.3, the film 50 passing over idler rollers 74.1 and 74.2 before it passes over the roller 12. The film 50 is pressed against the roller 12 by one or more pressing rollers 74.3.

Instead of a roll 50.3 being used, the apparatus may be so arranged that tubular film 50 is fed at a uniform rate over the idler rollers 74.1 and 74.2 directly from the draw-off rollers at the downstream end of a printing machine which is mounted downstream of and in line with an extruding machine.

During a full cycle of operation, the connection 70.62 and hence the cutter sealing member 20, describes the locus 70.621. The various parts of the link system describe the loci as set out in the following table:

| Link System Part or other Part | Part No. | Locus |
|---|---|---|
| Pivotal connection | 70.62 | 70.621 |
| Cutter sealing member | 20 | |

-continued

| Link System Part or other Part | Part No. | Locus |
|---|---|---|
| Pivotal connection | 70.61 | 70.611 |
| Pivotal connection | 70.51 | 70.511 |
| Pivotal connection | 70.31 | 70.311 |
| Pivotal connection | 70.71 | 71 |
| Pivotal connection | 70.32 | |

The effect of the link system is to arrange for the total lift of the member 20 to be reduced relative to the throw or total displacement of the crank pin 70.1 in accordance with the combined mechanical advantage of the lever 70.5 and the lever formed by the connecting rod 70.3. Thus, the cutter sealing member 20, in following the locus 70.621, travels with the roller periphery over a small arc for a short period, during which period cutting and sealing of the layers of plastic film take place.

Figure 5:
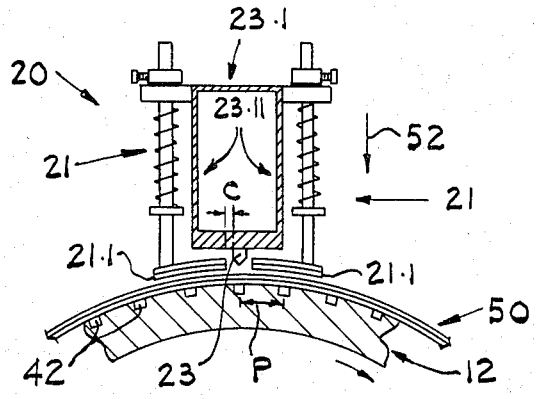
FIG. 5 shows diagrammatically a part cross-sectional view showing the roller and cutter sealing member.

Referring now to FIG. 5, there is shown the cutter sealing member 20 prior to inward movement to sever the plastic film 50. The member 20 includes biassed shoes 21 on opposite sides of the blade 23. The carrier 23.1 is of hollow box section provided with ventilating holes 23.11.

The shoes 21 include spring-loaded plungers mounted on the carrier 23.1 and have linings 21.1 of PTFE. The clearance space *c* between the blade 23 and opposed edges of the lining of shoes 21 should not exceed half the pitch *p* of the slots 42.

Figure 6:
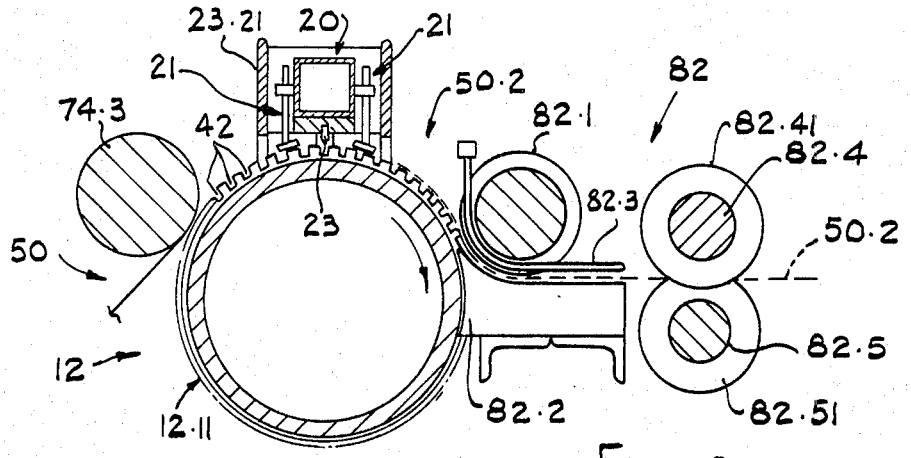
FIG. 6 shows a cross-section of the roller at VI—VI in FIG. 7 and of that part of the machine downstream from the roller.
Figure 7:
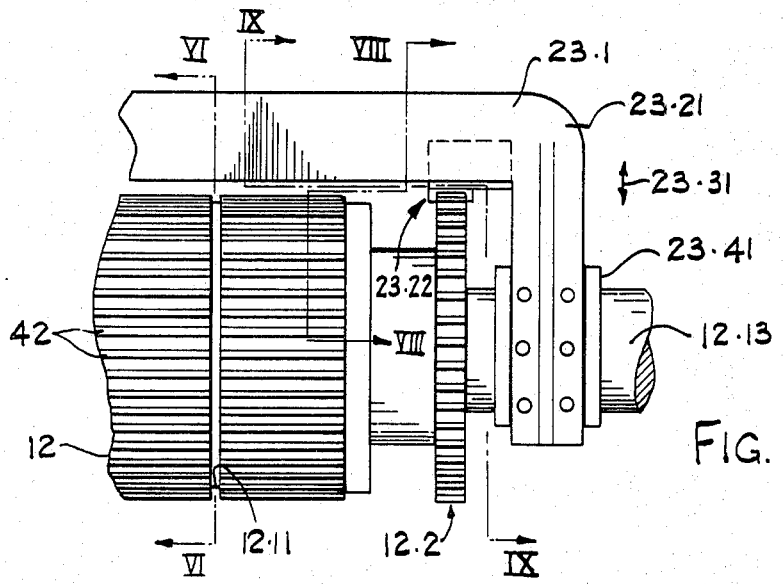
FIG. 7 shows a part front elevation of one end of the roller.
Figure 8:
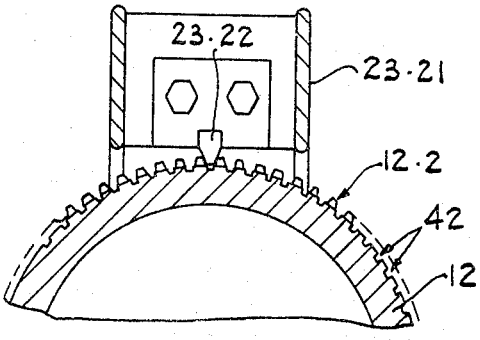
FIG. 8 shows a part cross-section at VIII—VIII in FIG. 7.

Referring now to FIGS. 6, 7 and 8 of the drawings, details are shown of the roller 12 and of a take-off mechanism 82 for the roller. The take-off mechanism 82 comprises a roller 82.1 rolling via the film 50 against the roller 12, and having a peripheral speed slightly larger by, say, about 15 – 20 percent, than the peripheral speed of the roller 12. This is to ensure that the film 50 is stretched on the roller downstream from the cutter sealing member 20, and to ensure that the two adjacent seals become separated and do not become welded together again.

The roller, besides having the axially extending grooves 42 spaced circumferentially, also has a plurality of axially spaced circumferential grooves 12.11. The widths of the grooves 12.11 are of the order of about 1 mm. Stripper or take-off members 82.2 are mounted to have their upstream ends projecting into the grooves 12.11. They act to strip bags 50.2 from the roller 12 and to guide them in co-operation with guide fingers 82.3 into intercalated corrugating rollers 82.4 and 82.5 arranged downstream from the members 82.2 and guide fingers 82.3. The corrugating rollers have undulations 82.41 and 82.51 staggered in an axial direction, and are adapted to roll past each other with clearance and out of contact with each other, and with the undulations mating to provide corrugations in the bags 50.2 as they pass between the rollers 82.4 and 82.5. In doing so, the bags acquire sufficient stiffness for them to be delivered in stacked relationship in a stacking zone 78. See also further the description with reference to FIG. 13.

Figure 9:
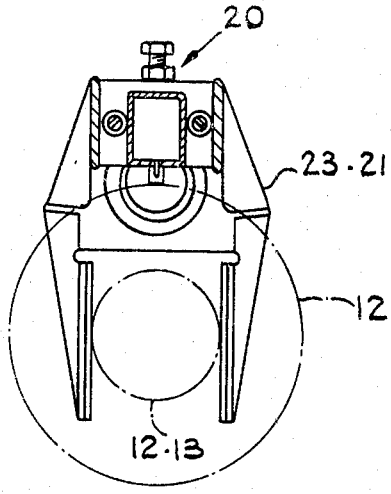
FIG. 9 shows a part cross-section at IX—IX in FIG. 7.

Referring now to FIG. 9 of the drawings, the cutter sealing member carrier 23.1 has aligned forks 23.21 at opposite ends thereof adapted to slide reciprocating fashion in the direction of arrow 23.31, in a linear guide 23.41 within which a shaft 12.13, fast with the roller 12, is adapted to rotate.

The roller 12 has gears 12.2 at is opposite ends, one of the gears being driven by drive roller 72.1. The teeth of these gears are identical in number to the number of grooves 42 and are at the identical pitch and are circumferentially aligned with the grooves. The carrier 23.1 is provided at each end with a mating formation in the form of a tooth 23.22 which is adapted to engage on its inward movement towards the axis of the roller 12, with the mating formations of the roller namely the teeth of the gears 12.2, thereby to ensure positive location and alignment of the cutter sealing member 20 and the blade 23 in relation to the slots 42. Such interengagement of the mating formations over an arc determined by the length of the stroke as ascertained from FIG. 4, ensures that the cutter sealing member travels in unison with the roller over the arc, and that it registers accurately with a slot during such travel. The interengagement of the mating formations also ensures that the blade 23 during the period of travel of the cutter sealing member remains radially orientated relative to the roller axis.

Figure 10:
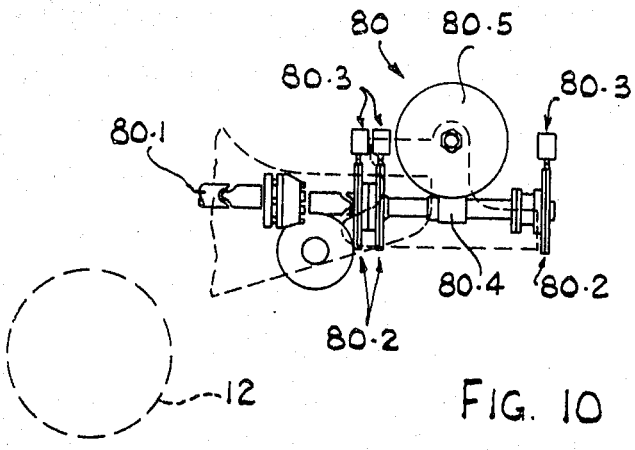
FIG. 10 shows a part side elevation of a cam assembly.

Referring now to FIG. 10 of the drawings, the counter means 80 comprises a drive shaft 80.1 driven from the crank wheel 70.2 and in synchronism therewith. The drive shaft is arranged to have cam faces 80.2 which in turn operate counter mechanism 80.3. The shaft 80.1 drives a worm 80.4 engaging with a wormwheel 80.5 having an appropriate number of teeth corresponding to the number of bags which are to be stacked in the stacking zone 78, and which is adapted to actuate bag removing means when the appropriate number of bags have been stacked in the stacking zone 78. The stacking zone may thus comprise bag removing means in the form of a platform, table, or belt, which is movable in response to one or more revolutions of the wheel 80.5.

Figure 11:
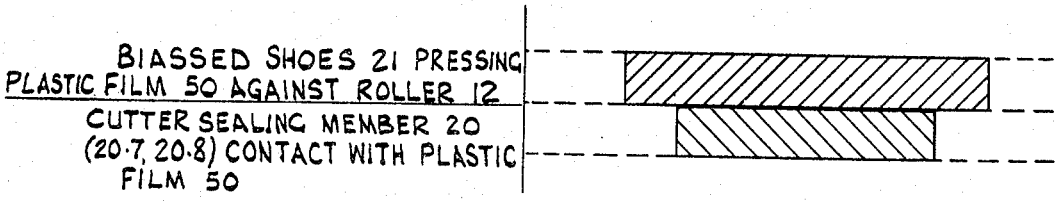
FIG. 11 shows a timing diagram showing the sequence of operations of the various components during a cycle of operations.

Referring now to FIG. 11 of the drawings, it will be noted that a timing diagram is shown, From this drawing it will be clear that for any one cycle of operation, the biassed shoes 21 will come into contact with the plastic film 50 on the roller 12, before the cutter sealing member 20 comes into contact therewith, and will still press the plastic layers against the roller, even after the cutter sealing member 20 has withdrawn.

Figure 12:
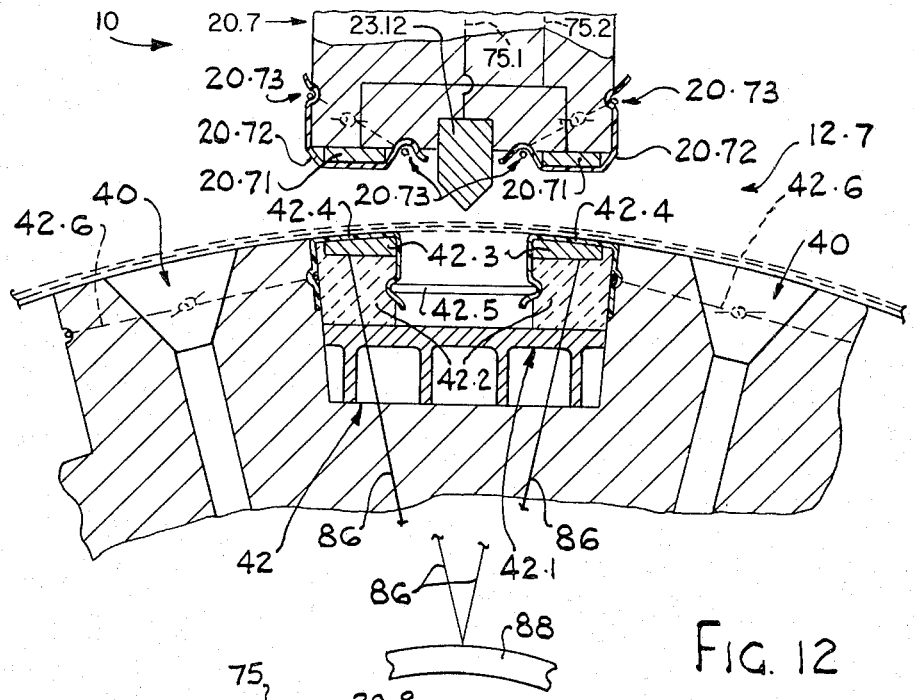
FIG. 12 shows diagrammatically a part-sectional end elevation of a double sealing cutter sealing member.
Figure 14:
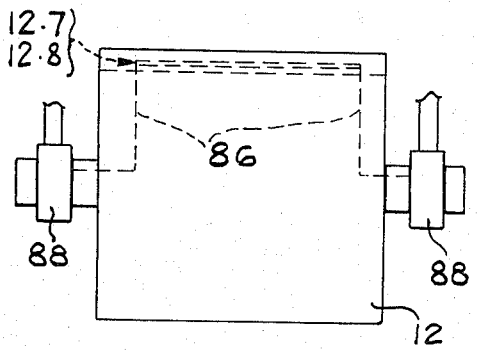
FIG. 14 shows diagrammatically a front elevation of the electrical circuitry of the cutter sealing members and rollers of FIGS. 12 and 13.

FIG. 12 shows a detail of a roller slot 42 and cutter sealing member 20.7. Inside the slot 42 there is mounted a heat sink 42.1 which may be of aluminium. There is provided an anvil 12.7 comprising, on either side of the slot 42, an insulator block 42.2 on top of which there are provided heating element sealing bars 42.3 secured to the blocks 42.2 and energized by conductors 86 from a slip ring 88. (See also FIG. 14). Each bar 42.3 has a covering 42.4 of polyetrafluoroethylene sheet (PTFE), available presently under the brand name TEFLON. The sheets 42.4 are held in position over the bars 42.3 and against the blocks 42.2 by means of a flat spring member 42.5 located in recesses in the blocks 42.2. The outer ends of the sheets 42.4 are held by wires 42.6 in recesses provided in the sides of the slots.

The cutter sealing member 20.7 has a heat cutter blade element 23.12 and sealing element strips 20.71. The element 23.12 and strips 20.71 are energized respectively in parallel via conductors 75.1 and 75.2. The strips 20.71 are covered by PTFE sheets 20.72 held in position by wires seating in recesses 20.73 in the member 20.7. The element 23.12 is arranged to be at a higher temperature than the bars 42.3 and sealing element strips 20.71.

Figure 13:
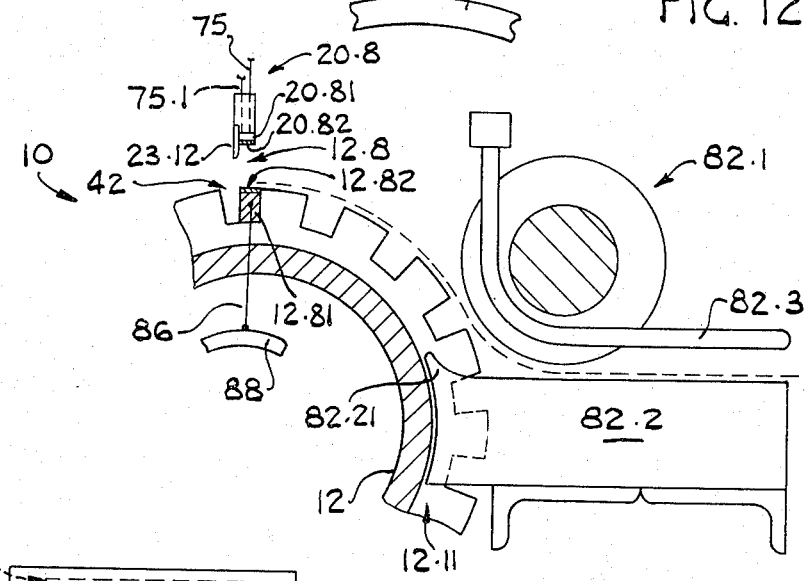
FIG. 13 shows diagrammatically a part-sectional end elevation of a bottom cutter sealing member with roller, and also a detail arrangement of take off members.

The cutter sealing member 20.8 shown in FIG. 13, is intended specifically for bottom sealing bags, i.e. on one side of the element 23.12 only. The member 20.8 and anvil 12.8 shown in FIG. 13, are similarly constructed, arranged and energized to the member 20.7 and anvil 12.7 respectively of arrangement of FIG. 12, except that sealing takes place on one side only. (See also FIG. 14). The element means 23.12, like the element 23.12 in FIG. 12, is arranged to be at a higher temperature than the sealing element strip 20.81 and the sealing bar 12.81. They are arranged to be energized respectively via conductors 75.1, 75.2 and 86.

To facilitate bag separation upon stripping, the anvil 12.8 may be arranged against the upstream side of the slot 42 instead of against the downstream side, as shown, the cutter sealing member 20.8 thus having its element 23.12 downstream of its sealing strip 20.81.

In both FIGS. 12 and 13 the fact that the element 23.12 is at a higher temperature than each associated sealing strip and sealing bar, and the fact that the element remains in contact with the film 50 momentarily after each strip is withdrawn from the corresponding bar, both tend to facilitate bag separation during stripping.

FIG. 13 also shows details of the take-off arrangement shown generally in FIG. 6. It will be noticed that the circumferential groove 12.11 is deeper than the slots 42. The upstream ends 82.21 of the take-off members 82.2 project radially inwardly of, and closer to the axis of the roller 12 than the bottoms of the slots 42. The PTFE covering for the bar 12.81 is shown at 12.82; and the PTFE covering for the strip 20.81 is shown at 20.82.

A bag-making machine as described above ensures accurate placement of cut and seal. This is particularly useful where film having printed matter on it has to be processed. The machine is therefore particularly useful for in line operation with an extruder and printer installation. An example of such an installation will now be described with reference to FIGS. 15, 16 and 17 of the drawings.

Figure 15:
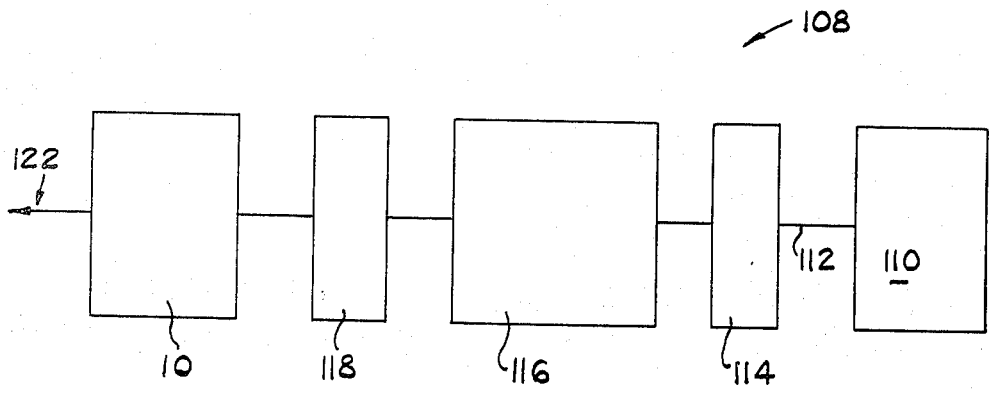
FIG. 15 shows diagrammatically a block diagram showing the progress of film from an extruder through to the finished bags.
Figure 17:
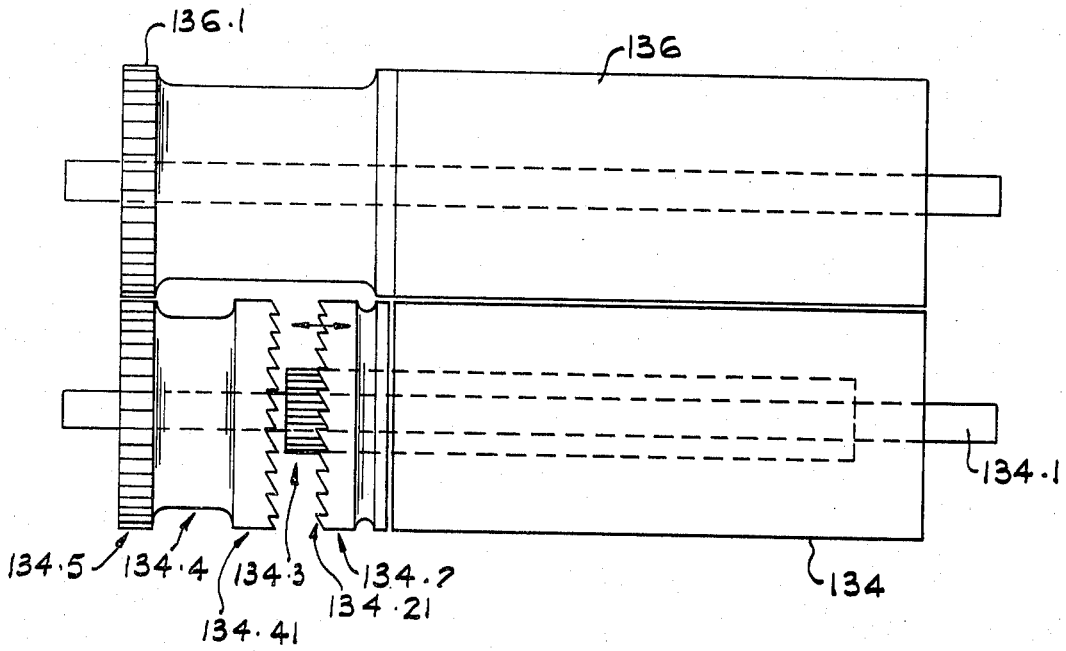
FIG. 17 shows in side elevation thereof the arrangement of the clutch on an impression roller, and the associated stereo cylinder.
Figure 16:
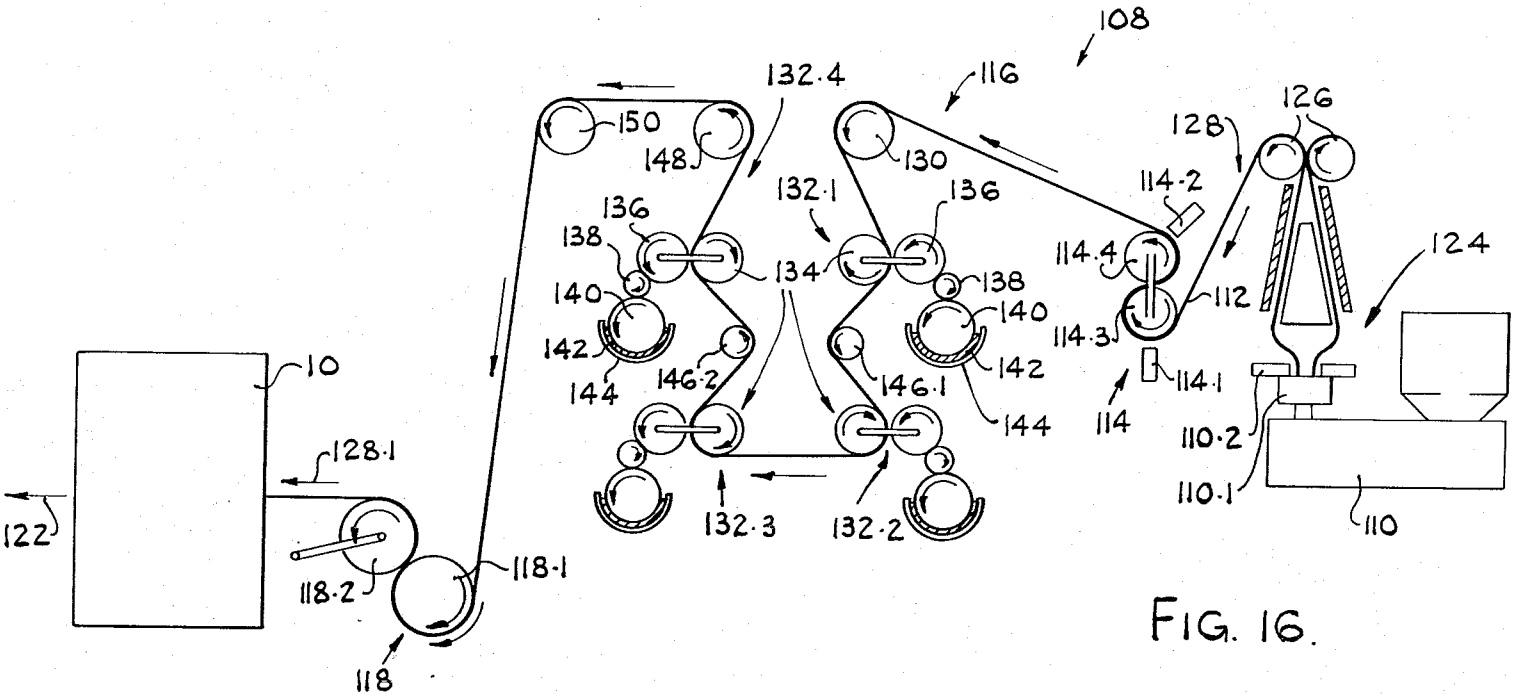
FIG. 16 shows diagrammatically a side elevation of an in line bag-making installation comprising various sets of apparatus arranged in accordance with the invention.

Referring now to FIGS. 15, 16 and 17 of the drawings, reference numeral 108 refers generally to an installation in accordance with the invention, comprising an extruder 110 feeding film 112 into a Corona discharge unit 114 for treating the film to accept printing. From the Corona discharge unit the film passes into the printer 116 and thence through the draw rollers 118 to bag-making machine 10, as described. The finished bags issue at 122 from the bag-making machine.

Referring now particularly to FIG. 16 of the drawings, the extruder 110 has a die 10.1 and a cooling air ring 110.2. The film is blown in the form of a bubble 124. It passes between nip rollers 126. It then passes in the form of a collapsed tube 128 through the Corona discharge unit 114 having Corona discharge bars 114.1 and 114.2. In passing through the Corona discharge unit, the film passes over rollers 114.3 and 114.4. These rollers are merely idler rollers. The film then passes into the printer, generally indicated by reference numeral 116. This printer comprises a deflecting roller 130.

After passing over the deflecting roller 130, the film passes into the first set of printing rollers 132.1. A set of printing rollers comprises a driven impression roller 134, a stereo cylinder 136 drivingly interconnected with the impression roller 134, a transfer or anilox roller 138, and an inking roller 140. The inking roller is adapted to dip into ink 142 held in a tray 144. Thereafter the film passes over a deflecting roller 146.1, and thence into a next set of printing rollers 132.2. Thereafter the film passes into a third set of printing rollers 132.3 and thence, after passing over a deflecting toller 146.2, it passes into a fourth set of printing rollers 132.4. Thence the film passes over the deflecting roller 148 over a further deflecting roller 150, and thence onto the draw rollers, generally indicated by reference numeral 118.

These draw rollers comprises a drive roller 118.1 which is driven in the direction of the arrow shown. The other roller of the draw rollers 118.2 is biassed to roll on the film against the drive roller 118.1. Thereafter the film passes in the direction of arrow 128.1, into the bag-making machine 10. The bags issue as indicated, at 122.

All the impression rollers 134 and the driving draw roller 118.1, are driven in synchronism from a suitable rotary power source. The various rollers may conveniently be interconnected by drive shafting, or by chain drive to rotate at the appropriate speeds. Alternatively, they may be driven by suitably interlocked electrical drive means arranged to run in synchronism with each other.

Any one of the sets of printing rollers may be taken out of commission by merely disengaging the drive from the impression roller of that set, to its stereo cylinder. This may be done by declutching the stereo cylinder from the impression roller.

Referring now to FIG. 17 of the drawings, there is shown an impression roller 134 which receives rotary drive at its shaft 134.1. A toothed sliding member 134.2 is axially slidable on a splined portion 134.3 fast with the roller 134. The teeth 134.21 of the sliding member are engageable with teeth 134.41 of a mating portion 134.4 which is freely rotatable about the shaft 134.1. The part 134.4 has teeth 134.5 meshing with teeth 136.1 fast with the stereo roller 136. The drive between the impression roller 134 and the stereo cylinder 136, may be engaged or disengaged by suitably positioning the sliding member 134.2, i.e. by bringing the teeth 134.21 and 134.41 into or out of engagement, as desired. When the member 134.2 and portion 134.4 are out of engagement as shown in the drawing then the shaft 134.1 rotates freely within the portion 134.4 and no driving torque is transmitted to the roller 136 via the teeth 134.5 and 136.1. The sliding member 134.2 thus acts as a clutch.

This facility permits the changing of stereo cylinders even while the film continues to pass over the impression roller 134. This provides a feature which is particularly useful in an in line installation whereby it becomes possible to change the printing rollers without stopping the operation of the installation as a whole.

This apparatus has the advantage that it makes possible the economic production of small runs of printed bags.

I claim:

1. A bag-making machine, which includes:

a. a cylindrical roller having means to rotate said roller about its axis, the roller having a plurality of circumferentially spaced longitudinal slots in its periphery;

b. feed means adapted to feed a continuous web of heat-sealable synthetic plastics material to the roller at a rate corresponding to the rate of rotation of the roller;

c. a cutter sealing member mounted to be displaceable both radially relative to the roller axis and arcuately about the roller axis and having a cutter blade adapted in operation to register with and to enter into a slot of the roller, the cutter sealing member thereby cutting and sealing the film layers;

d. displacing means for cyclically displacing the cutter sealing member arcuately about and radially relative to the roller axis and in synchronism with the roller, the displacing means including a crank wheel meshing with a toothed wheel fast and coaxial with the roller and driven thereby, and a link lever system connected via a crank pin to the crank wheel and adapted to displace the cutter sealing member to have a reciprocating movement to cause the cutter sealing member to perform working and return strokes while moving in a closed loopshaped path; and e. mating formations fast with the roller and with the cutter sealing member respectively, and adapted to engage with each other at the start of a cycle of operation, and to move in unison with each other over an arc about the roller axis, and to disengage from each other at the end of the arc, the mating formations being adapted to ensure, upon interengagement with each other, that the cutter blade registers accurately with and remains in registration with a slot in the roller surface during the period of travel over the arc, during which period the mating formations are engaged and the cutter sealing member and roller are moving in unison over the arc, and during which period sealing and cutting of the film layers is taking place.

2. An inline bag-making installation comprising:

a bag-making machine as claimed in claim 1;

draw rollers mounted in line with and upstream of the bag-making machine;

a printer in line with and upstream of the draw rollers, the printer having at least one set of printing rollers comprising an impression roller and a stereo roller and other associated rollers; and interconnecting drive means drivingly interconnecting the cylindrical roller of the bag-making machine with the draw rollers and with the or all the impression rollers of the or all the sets of printing rollers, for synchronous operation of the said interconnected rollers.

3. An inline installation as claimed in claim 2, in which there is provided an extruder with nip rollers, upstream of the printer.

4. An inline installation as claimed in claim 2, in which there is provided a clutch between the impression roller and the stereo roller of each set of printing rollers, the clutch being disengageable to bring its associated stereo roller to a stop while film is passing over the impression roller.

5. A machine as claimed in claim 2, in which the link lever system is adapted to reduce the displacement of the cutter sealing member in a direction transverse to the direction of travel of the web to a value less than the throw of the crank pin.

6. A machine as claimed in claim 2, in which the number of teeth of the toothed wheel corresponds to the number of slots in the roller, the toothed wheel forming part of the mating formation for the roller and the mating formation for the cutter sealing member including at least one tooth adapted to mesh with the said toothed wheel.

7. A machine as claimed in claim 2, in which the cutter sealing member includes a carrier which carries the cutter blade, and in which the carrier includes a pair of aligned forks at opposite ends of the roller, the forks permitting displacement of the carrier both arcuately about and radially relative to the roller axis.

8. A machine as claimed in claim 7, and in which the cutter blade is resiliently mounted on the carrier to be resiliently displaceable away from the roller axis relative to the carrier.

9. A machine as claimed in claim 2, in which the roller has a plurality of axially spaced narrow circumferential grooves at least as deep as the longitudinal slots, and in which there are provided take-off fingers having their upstream ends within the circumferential grooves and extending downstream away from the roller relative to its direction of rotation.

10. A machine as claimed in claim 9, in which the take-off fingers are in the form of thin plates and the circumferential grooves are of a width to accommodate the take-off fingers with running clearance.

11. A machine as claimed in claim 9, in which the circumferential grooves are deeper than the longitudinal slots, and in which the take-off fingers project radially into the grooves to such an extent that at least part of the upstream ends of the take-off fingers are closer to the axis of the roller than the bottoms of the longitudinal slots.

12. A bag-making machine, which includes:

a. a cylindrical roller having means to rotate said roller about its axis;

b. feed means adapted to feed a continuous web of heat-sealable synthetic plastics material to the roller at a rate corresponding to the rate of rotation of the roller;

c. a cutter sealing member disposed transversely to the direction of feed of the web and mounted to be displaceable both radially relative to the roller axis and arcuately about the roller axis and adapted to cut and seal the film layers;

d. displacing means for cyclically displacing the cutter sealing member arcuately about and radially relative to the roller axis and in synchronism with the roller, the displacing means including a crank wheel meshing with a toothed wheel fast and coaxial with the roller and driven thereby, and a link lever system connected via a crank pin to the crank wheel and adapted to displace the cutter sealing member to have a reciprocating movement to cause the cutter sealing member to perform working and return strokes while moving in a closed loop-shaped path; and e. mating formations fast with the roller and with the cutter sealing member respectively, and adapted to engage with each other at the start of a cycle of operation, and to move in unison in engagement with each other over an arc about the roller axis, and to disengage from each other at the end of the arc, the mating formations being adapted to ensure, upon interengagement with each other, that the cutter sealing member and roller move accurately and in unison during the period of travel of the mating formations over the arc, during which period sealing and cutting of the film layers is taking place.

* * * * *

UNITED STATES PATENT OFFICE

CERTIFICATE OF CORRECTION

Patent No. 3,947,198 Dated March 30, 1976

Inventor(s) THOMAS GOUGH HUTT

It is certified that error appears in the above-identified patent and that said Letters Patent are hereby corrected as shown below:

Column 11, line 59, should read as follows:

5. A machine as claimed in claim 1, in which the link

Column 11, line 64, should read as follows:

6. A machine as claimed in claim 1, in which the

Column 12, line 3, should read as follows:

7. A machine as claimed in claim 1, in which the

Column 12, line 13, should read as follows:

9. A machine as claimed in claim 1, in which the

Signed and Sealed this

Fourth Day of March 1980

[SEAL]

*Attest:*

SIDNEY A. DIAMOND

*Attesting Officer* *Commissioner of Patents and Trademarks*